US006264494B1

(12) United States Patent
Chen

(10) Patent No.: US 6,264,494 B1
(45) Date of Patent: Jul. 24, 2001

(54) ELECTRIC CABLE AND CONNECTOR ARRANGEMENT

(76) Inventor: Wilson Chen, 4F, No. 3, Alley 9, Lane 45, Pao-Hsin Rd., Hsin-Tien, Taipei (TW)

( * ) Notice: Subject to any disclaimer, the term of this patent is extended or adjusted under 35 U.S.C. 154(b) by 0 days.

(21) Appl. No.: 09/710,858

(22) Filed: Nov. 14, 2000

(51) Int. Cl.[7] ..... H01R 11/20
(52) U.S. Cl. ..... 439/404; 439/701
(58) Field of Search ..... 439/395, 404, 439/405, 492, 494, 417, 701

(56) References Cited

U.S. PATENT DOCUMENTS 5,766,033 * 6/1998 Davis ..... 439/404 X
6,174,195 * 1/2001 Yang ..... 439/497
6,179,644 * 1/2001 Adams et al. ..... 439/387
6,210,204 * 4/2001 Ko et al. ..... 439/404

* cited by examiner

*Primary Examiner*—Khiem Nguyen
(74) *Attorney, Agent, or Firm*—Rosenberg, Klein & Lee

(57) ABSTRACT

An electric cable and connector arrangement in which a harness is fastened to the electric wires of the data transmission cable to hold the electric wires in a row, for enabling the electric wires to be accurately and quickly arranged in respective wire grooves of a wire distribution plate of the electric connector, and the connector head of the electric connector has two bottom mounting legs respectively plugged into respective plug holes in the housing of the electric connector.

1 Claim, 6 Drawing Sheets

ELECTRIC CABLE AND CONNECTOR ARRANGEMENT

BACKGROUND OF THE INVENTION

The present invention relates to an electric cable and connector arrangement and, more particularly, to such an electric cable and connector arrangement, in which harness means is installed in the data transmission cable to hold the electric wires in a row so that the electric wires can accurately and quickly be installed in respective wire grooves on of the wire distribution plate of the electric connector.

FIG. 1 shows an electric cable and connector arrangement for data transmission according to the prior art. According to this arrangement, the electric connector, referenced by 10', comprises a housing 20' defining a receiving chamber 22', a wire distribution plate 40', a holding-down plate 44', and a connector head 50'. The cable, referenced by 30', is inserted from the rear side of the housing 20' into the receiving chamber 22', comprising a set of electric wires 32', and an aluminum foil layer 38' embedded within the outer insulative layer thereof and wrapped on the electric wires 32'. The wire distribution plate 40' and the holding-down plate 44' each have a plurality of wire grooves 48' respectively arranged at the top or bottom side. The electric wires 32' of the cable 30' are respectively mounted in the wire grooves 48' of the wire distribution plate 40' and the holding-down plate 44'. The holding-down plate 44' is fastened to the wire distribution plate 40' to hold down the electric wires 32' of the cable 30' in the wire grooves 48'. The wire-distribution plate 40' comprises a plurality of pin holes 42'. The holding-down plate 44' comprises a plurality of bottom pins 46' respectively press-fitted into the pinholes 42' of the wire distribution plate 40'. The connector head 50' comprises a set of contact pins 51' for power and data signal transmission. The contact pins 51' each have a sharp, notched bottom mounting end adapted for connecting to the conductor of each electric wire 32' of the cable 30'. After the holding-down plate 44' and the wire distribution plate 40' had been fastened together to hold down the electric wires 32' of the cable 30', the connector head 50' is fastened to the housing 20' and covered on the receiving chamber 22' to force the contact pins 52' against the electric wires 32', and therefore the sharp, notched bottom end of each contact pin 52' pierces the insulator of each electric wire 32' of the cable 30' to achieve a respective electric contact. This cable and connector arrangement still has drawbacks as outlined hereinafter:

1. Because the electric wires 32' go off in different directions after the outer insulator and aluminum foil layer 39 of the cable 30' had been cut off at a distance, it takes much time to arrange the electric wires 32' in the wire grooves 48' of the wire distribution plate 40' and the holding-down plate 44', and the electric wires 32' may be erroneously arranged in wrong positions.
2. The complicated procedure of the arrangement of the electric wires 32' affects the speed of the processing work and the quality of the finished product.
3. After connection of the connector head 50' to the housing 20', an additional encapsulation or fixation procedure is required to fixedly secure the housing 20' and the connector head 50' together.

SUMMARY OF THE INVENTION

The present invention has been accomplished to provide an electric cable and connector arrangement, which eliminates the aforesaid drawbacks. It is one object of the present invention to provide an electric cable and connector arrangement, which keeps the electric wires of the cable in a row for quick installation. It is another object of the present invention to provide an electric cable and connector arrangement, which keeps the electric wires of the cable in a line so that the electric wires can be accurately positioned without causing a contact error. According to one aspect of the present invention, a harness is fastened to the electric wires of the data transmission cable to hold the electric wires in a row, for enabling the electric wires to be quickly arranged in respective wire grooves of a wire distribution plate of the electric connector. Because the electric wires of the data transmission cable is held in a row by the harness, the electric wires can be accurately arranged in the respective wire grooves in the wire distribution plate and the holding-down plate of the electric connector. According to another aspect of the present invention, the housing of the electric connector comprises two plugholes longitudinally arranged in parallel, and the connector head of the electric connector has two bottom mounting legs respectively plugged into the plugholes of the housing by force. After press-fitting the mounting legs of the connector head into the plugholes of the housing, the electric connector is well assembled, and no additional encapsulation procedure is needed.

DETAILED DESCRIPTION OF THE PREFERRED EMBODIMENT

Figure 3:
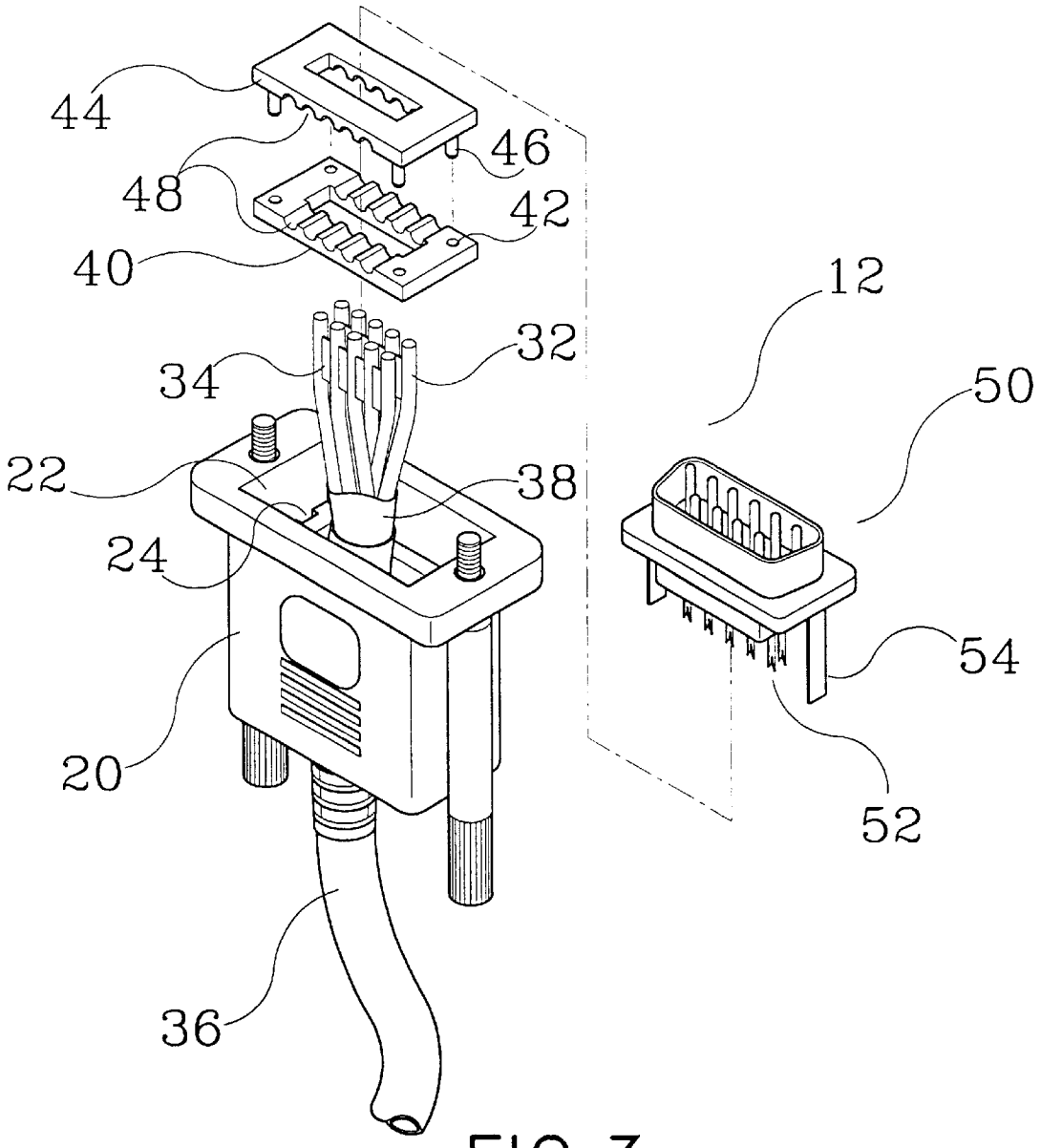
FIG. 3 is an exploded view of an electric cable and connector arrangement according to the present invention.
Figure 4:
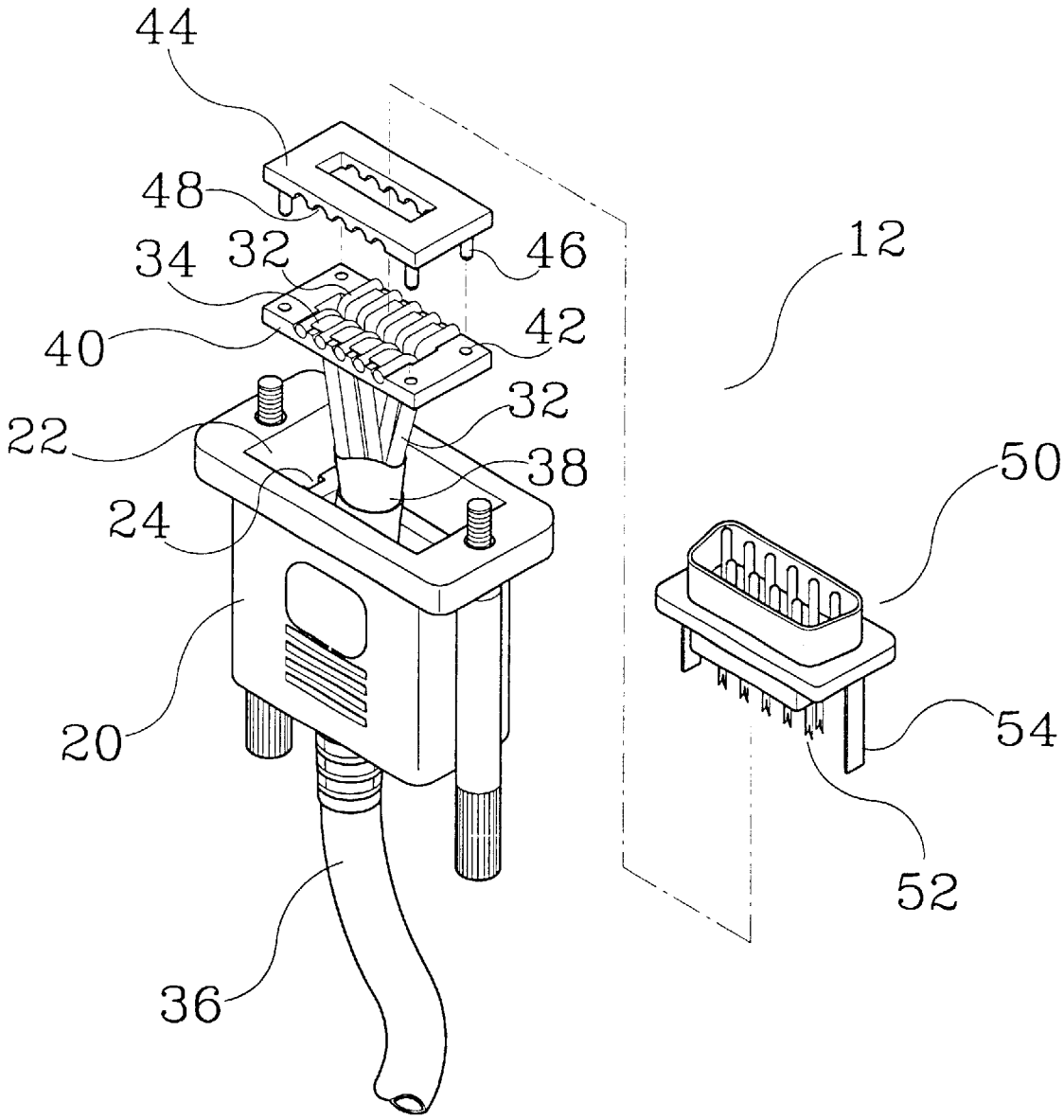
FIG. 4 is similar to FIG. 3 but showing the electric wires of the cable fastened to the wire distribution plate.
Figure 5:
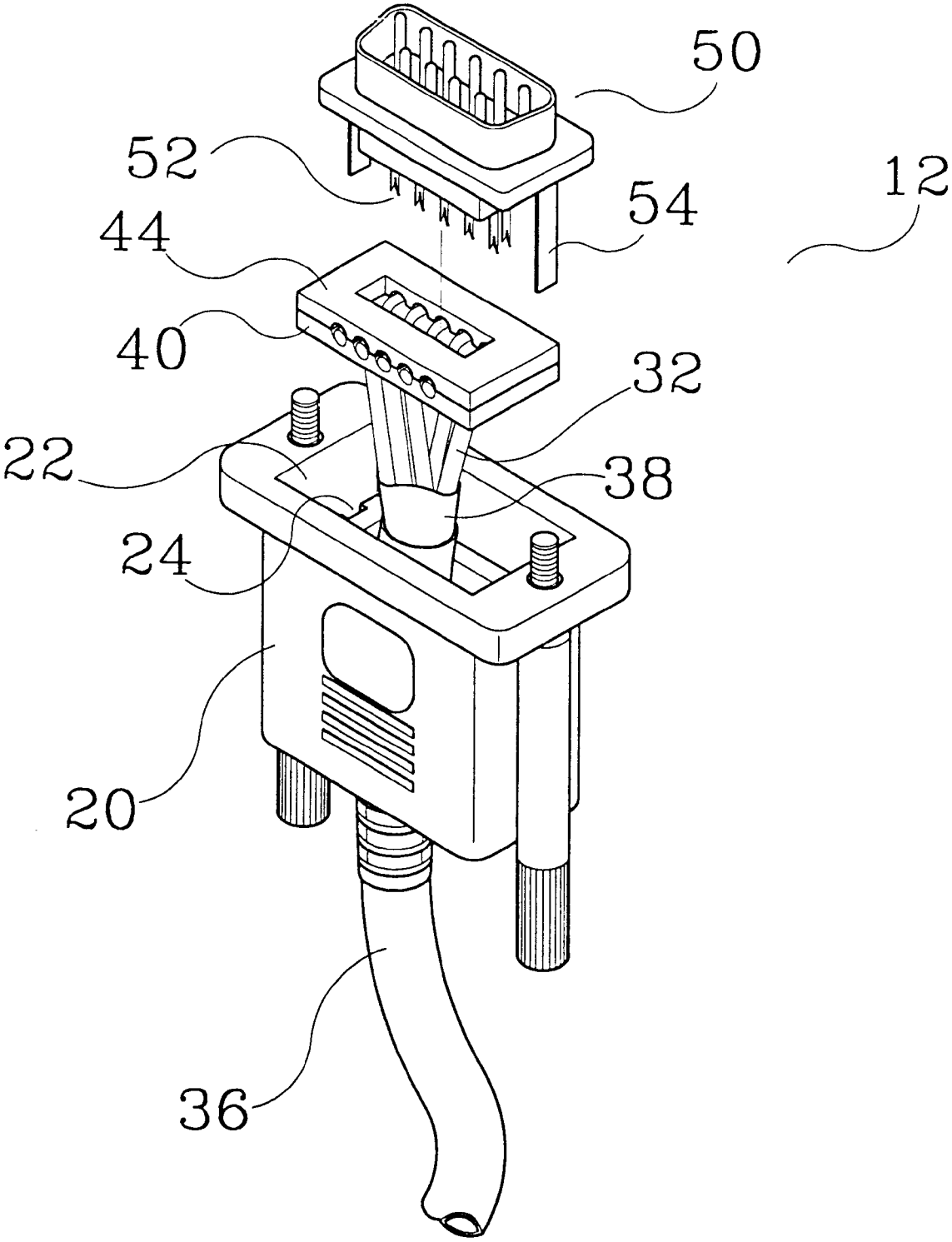
FIG. 5 is similar to FIG. 4 but showing the holding-down plate fastened to the wire distribution plate.

Referring to FIG. 3, the present invention comprises an electric connector 12, and a data transmission cable 36. The electric connector 12 comprises a housing 20 defining a receiving chamber 22, a wire distribution plate 40, a holding-down plate 44, and a connector head 50.

Figure 1:
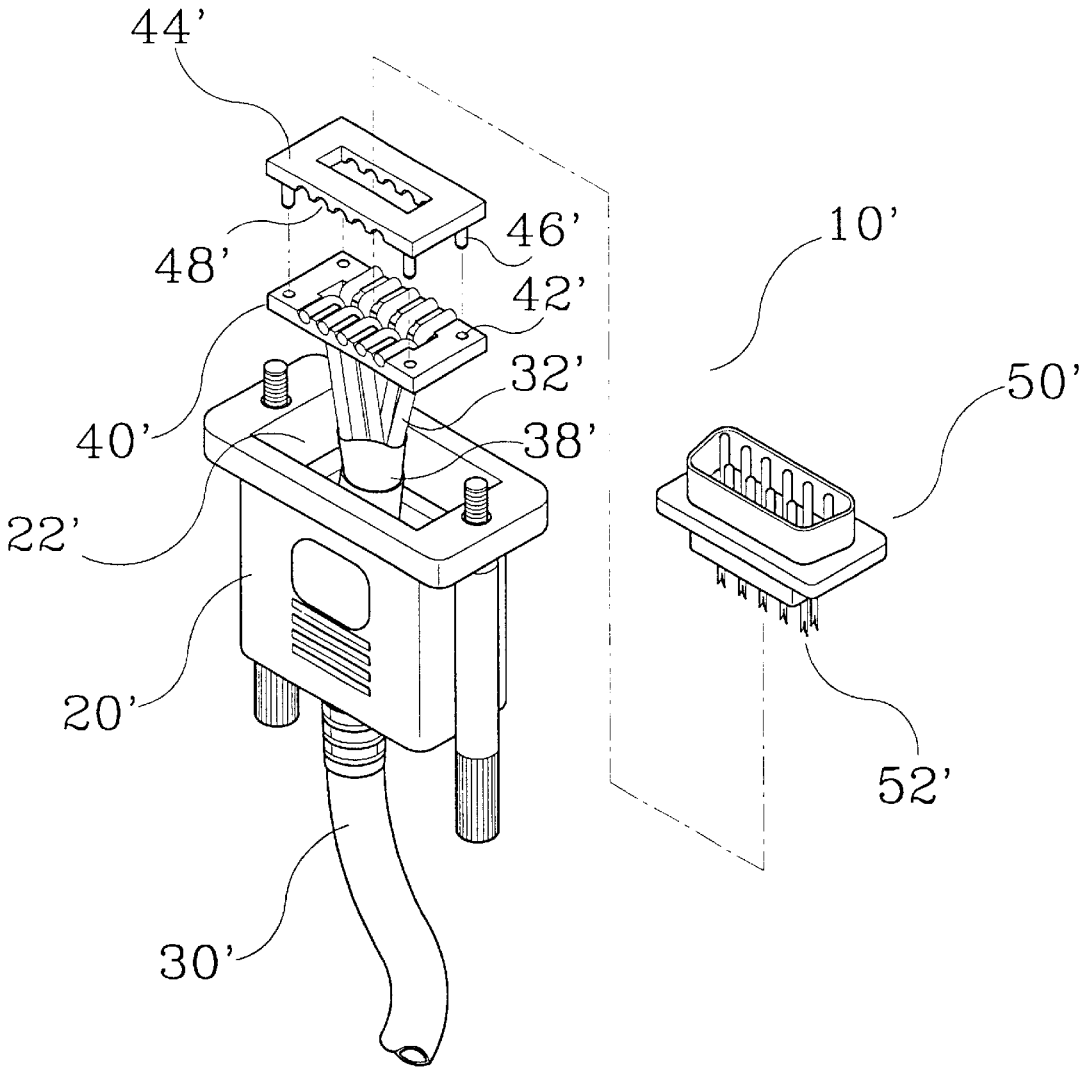
FIG. 1 PRIOR ART
FIG. 1 is an exploded view of an electric cable and connector arrangement according to the prior art.
Figure 2:
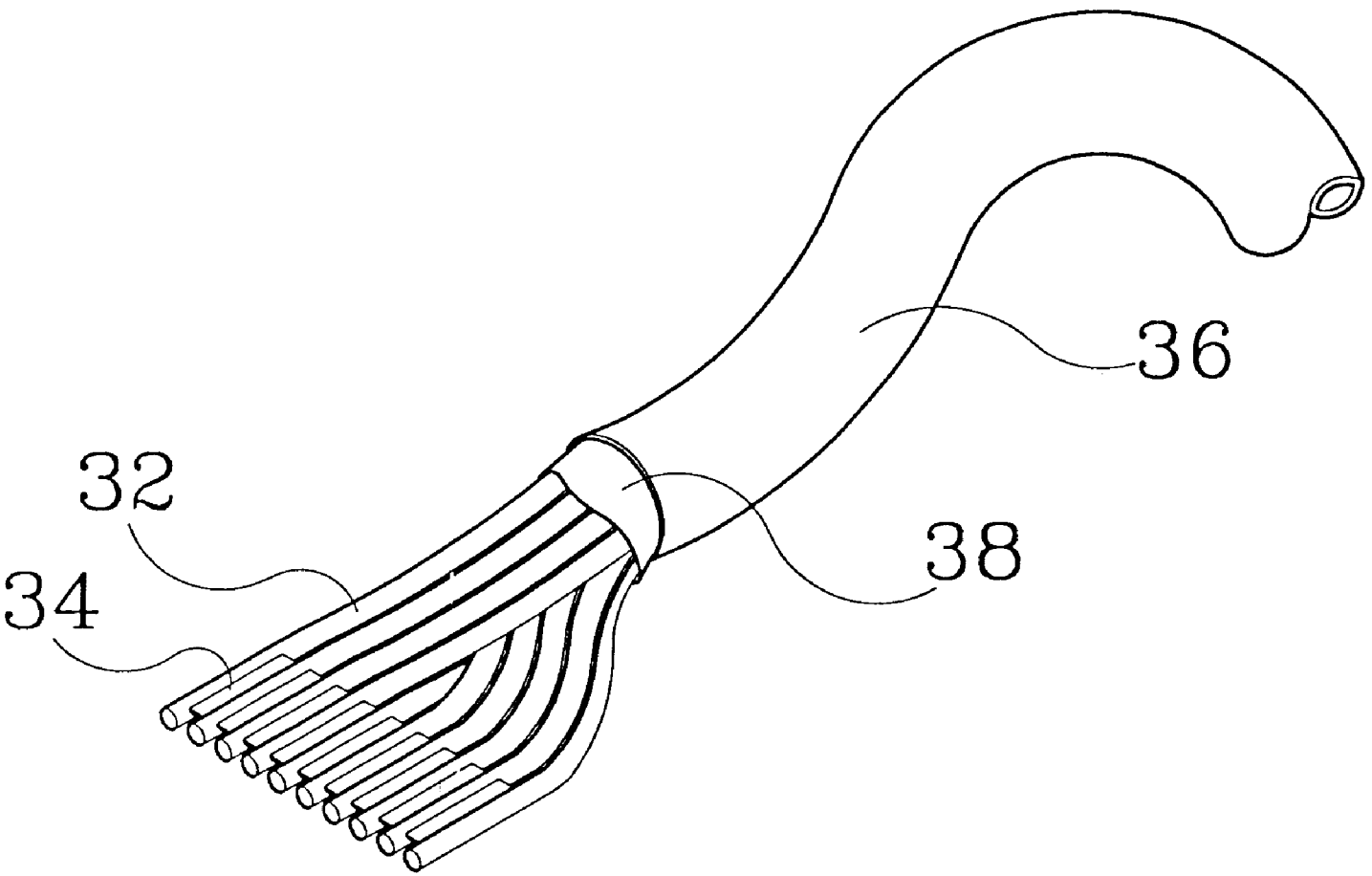
FIG. 2 illustrates a harness fastened to the electric wires of the cable, and the electric wires held in a row.

Referring to FIG. 2, the data transmission cable 36 comprises a set of electric wires 32 covered within an outer insulator thereof, and an aluminum foil layer 38 embedded within the outer insulator and wrapped on the electric wires 32. Further, a harness 34 is fastened to the electric wires 32 of the data transmission cable 36 to hold the electric wires 32 positively in a row for quick installation after the aluminum foil layer 38 and outer insulator of the data transmission cable 36 had been cut at a suitable length.

Referring to FIGS. from 4 through 7 and FIG. 3 again, the data transmission cable 36 is inserted from the rear side of the housing 20 into the receiving chamber 22, and connected to the wire distribution plate 40. The wire distribution plate 40 and the holding-down plate 44 each have a plurality of wire grooves 48 respectively arranged at the top or bottom side and adapted to receive the electric wires 32 of the data transmission cable 36. After insertion of the data transmission cable 36 into the receiving chamber 22 of the housing 20, the electric wires 32 of the data transmission cable 36 are respectively arranged in the wire grooves 48 of the wire distribution plate 40 and the holding-down plate 44. The holding-down plate 44 is fastened to the wire distribution plate 40 to hold down the electric wires 32 of the data transmission cable 30 in the wire grooves 48. Because the harness 34 holds the electric wires 32 positively in a row, the electric wires 32 can easily and quickly be arranged in the wire grooves 48 of the wire distribution plate 40 and the holding-down plate 44. The wire-distribution plate 40 comprises a plurality of pinholes 42. The holding-down plate 44 comprises a plurality of bottom pins 46 respectively press-fitted into the pinholes 42 of the wire distribution plate 40. The connector head 50 comprises a set of contact pins 52 for power and data signal transmission. The contact pins 52 each have a sharp, notched bottom mounting end adapted for connecting to the conductor of each electric wire 32 of the cable 30. After the holding-down plate 44 and the wire distribution plate 40 had been fastened together to hold down the electric wires 32 of the data transmission cable 36, the connector head 50 is fastened to the housing 20 and covered on the receiving chamber 22 to force the contact pins 52 against the electric wires 32, and therefore the sharp, notched bottom end of each contact pin 52 pierces the insulator of the respective electric wire 32 of the data transmission cable 36 to achieve a respective electric contact.

Figure 7:
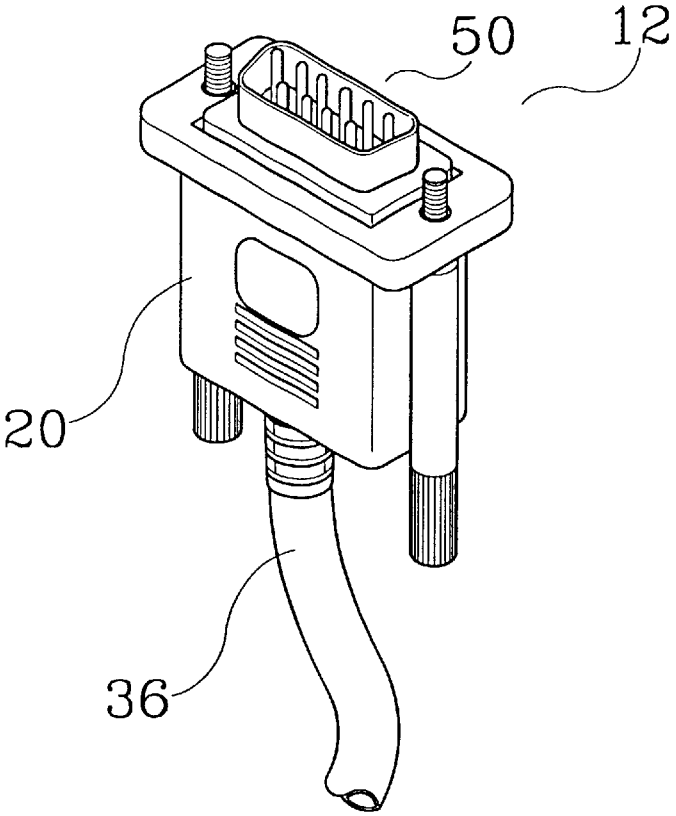
FIG. 7 is an elevational view showing the cable and connector arrangement assembled.
Figure 6:
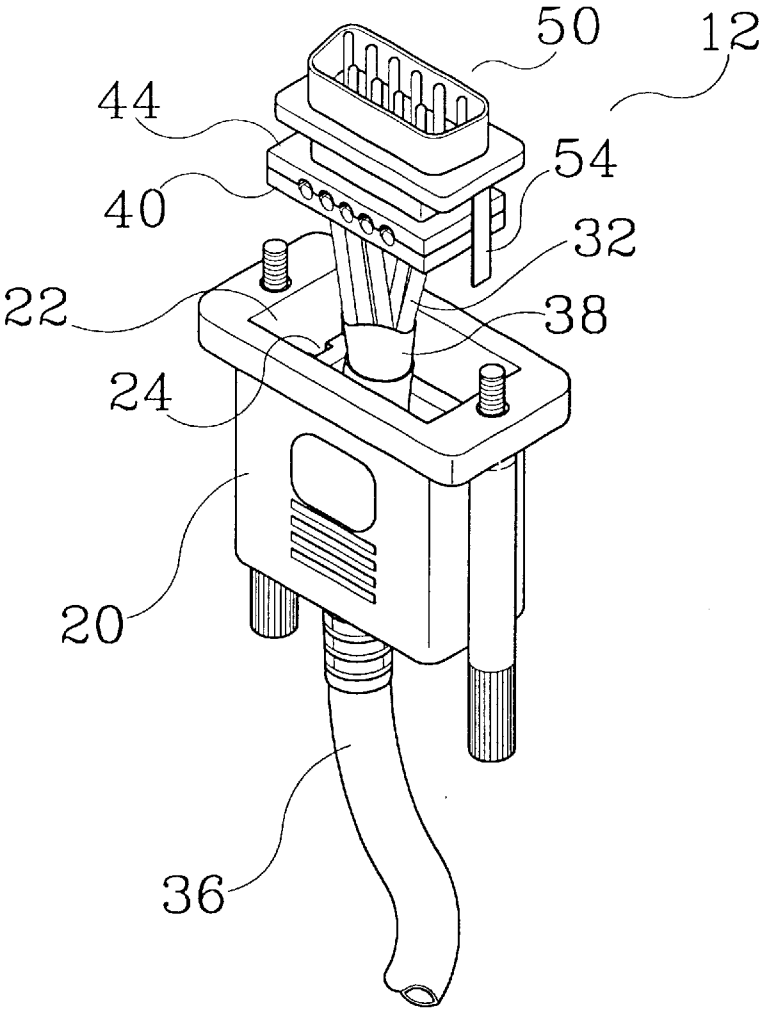
FIG. 6 is similar to FIG. 5 but showing the connector head fastened to the holding-down plate and the wire distribution plate.

Referring to FIGS. 6 and 7 again, the housing 20 comprises two plugholes 24 longitudinally arranged in parallel and disposed at two sides of the receiving chamber 22. The connector head 50 comprises two bottom mounting legs 54 respectively plugged into the plugholes 24 by force.

While only one embodiment of the present invention has been shown and described, it will be understood that various modifications and changes could be made thereunto without departing the spirit and scope of the invention disclosed.

What the invention claimed is:

1. An electric cable and connector arrangement of the type comprising: a data transmission cable, said data transmission cable comprising a set of electric wires covered within an outer insulator thereof, and an aluminum foil layer embedded within said outer insulator and wrapped on said electric wires; and an electric connector connected to said data transmission cable, said electric connector comprising a housing defining a receiving chamber, which receives said data transmission cable, a wire distribution plate, said wire distribution plate comprising a plurality of wire grooves, which receive said electric wires of said data transmission cable respectively, a holding-down plate fastened to said wire distribution plate to hold down said electric wires of said data transmission cable in said wire grooves, and a connector head fastened to said housing and covered on said receiving chamber, said connector head comprising a plurality of contact pins respectively pierced through insulator means of said electric wires to contact respective conductors in said electric wires;

wherein a harness is fastened to said electric wires of said data transmission cable to hold said electric wires in a row for enabling said electric wires to be arranged in said wire grooves of said wire distribution plate and said holding-down plate respectively; said housing comprises two plug holes longitudinally arranged in parallel and disposed at two sides of said receiving chamber for receiving said connector head; said connector head comprises two bottom mounting legs respectively plugged into said plug holes of said housing by force.

* * * * *